US005665053A

United States Patent [19]

Jacobs

[11] Patent Number: 5,665,053

[45] Date of Patent: Sep. 9, 1997

[54] APPARATUS FOR PERFORMING ENDERMOLOGY WITH ULTRASOUND

[76] Inventor: Robert A. Jacobs, 99 Cliff Rd, Belle Terre, N.Y. 11777

[21] Appl. No.: 722,310

[22] Filed: Sep. 27, 1996

[51] Int. Cl.[6] ..... A61H 1/00

[52] U.S. Cl. ..... 601/2; 601/6; 601/123; 601/133

[58] Field of Search ..... 601/123, 7, 2, 601/3, 6, 19, 133, 134; 604/22

[56] References Cited

U.S. PATENT DOCUMENTS

| | | |
|---|---|---|
| 2,752,914 | 7/1956 | Pohlman . |
| 4,729,368 | 3/1988 | Guitay . |
| 4,883,047 | 11/1989 | Guitay . |
| 5,143,063 | 9/1992 | Fellner . |
| 5,514,086 | 5/1996 | Parisi et al. . |

*Primary Examiner*—Marvin M. Lateef
*Assistant Examiner*—Derrick Fields
*Attorney, Agent, or Firm*—Collard & Roe, P.C.

[57] ABSTRACT

An endermology body massager having at least two rollers spaced from each other in a parallel configuration. The rollers rotate in the same direction and are rotatably mounted movable axes. A vacuum source is connected to the chamber that houses the rollers. The vacuum source facilitates the suction of the skin between the rollers and helps bring the rollers closer to each other during operation. The rollers or housing have ultrasound generators that are selectively controlled by the operator. In a first embodiment, the ultrasound generators are located within the rollers. In the second embodiment, the ultrasound generators are disposed in the housing around the rollers. Therefore, a controlled and combined endermology with ultrasound treatment can be achieved.

8 Claims, 4 Drawing Sheets

APPARATUS FOR PERFORMING ENDERMOLOGY WITH ULTRASOUND

BACKGROUND OF THE INVENTION

1. Field of the Invention

The present invention relates to Endermology. More particularly, it relates to an apparatus for performing endermology while simultaneously applying ultrasound.

2. The Prior Art

Endermology is a process for the treatment of the skin and subcutaneous tissue, whereby the skin is elevated with external suction and then rolled between motorized rollers.

U.S. Pat. No. 4,729,368 to Guitay, discloses an apparatus for massaging the human body. The invention consists of a pair of spaced rollers disposed in a housing with a belt drive system. The action of the rollers creates a suction on the skin between the rollers. No vacuum source is disclosed.

U.S. Pat. No. 4,883,047 to Guitay, discloses an apparatus for massaging the human body. The apparatus consists of a pair of spaced rollers for contact with the skin, and a vacuum source to be connected thereto.

U.S. Pat. No. 5,143,063 to Fellner, discloses a method of removing adipose tissue from the body. The invention consists of a method of focusing radiant energy on a localized area of adipose tissue, and maintaining the application of radiant energy until cell destruction occurs.

SUMMARY OF THE INVENTION

The present invention provides an apparatus for performing endermology while simultaneously applying ultrasonic wave energy to the desired treatment area.

According to the invention, an endermology device includes ultrasound generators/transducers that can be selectively activated by the operator. The endermology device includes a pair of spaced rollers that contact the patient's skin, and a vacuum or suction source that causes the skin to be drawn between the pair of rollers. As the skin is drawn between the rollers, the rollers are axially displaced toward each other to aid in the breakdown of the subcutaneous tissue.

In a first embodiment of the invention, ultrasound generators are disposed within the rollers themselves. A power supply is coupled to the ultrasound generators/ transducers via a rotary electric switch, and an external switch is connected to the power supply to enable the selective activation of the ultrasonic wave energy.

In a second embodiment of the invention, ultrasound generators/transducers are disposed within the housing of the endermology device adjacent to, and surrounding the rollers.

Thus, when using an endermology device, the operator can locally apply ultrasound to the areas of the body being treated and thereby increase the ability to breakdown fatty subcutaneous tissue.

It is therefore an object of the present invention to provide an apparatus for performing endermology while simultaneously applying ultrasonic wave energy to a local treatment area.

It is another object of the invention to provide an apparatus for performing endermology that utilizes ultrasonic wave energy to increase the breakdown of subcutaneous fatty tissue.

Another object of the invention is to provide an apparatus for performing endermology with ultrasonic energy that operates efficiently and reliably.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
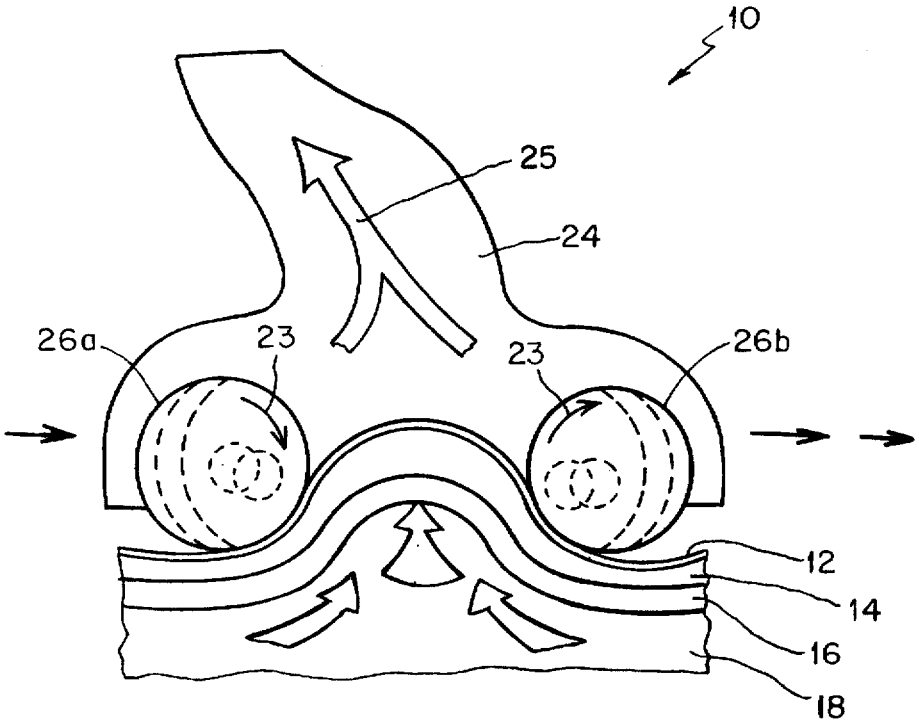
FIG. 1 (PRIOR ART)
FIG. 1 is a plan view of an endermology apparatus (body massager) of the prior art.

Turning now in detail to the drawings, FIG. 1 shows an endermology apparatus or skin massaging machine 10 according to the prior art. Device 10 has a pair of rollers **26*a* and 26*b* that engage the skin 12. A vacuum source (not shown) is coupled to a vacuum connection 24 to provide a negative suction 25 from the skin surface 12. During operation, the suction 25 and motorized rotation of rollers 26*a* and 26*b* draws the skin up between the rollers and enables the breakdown of subcutaneous fatty tissue by massaging the area. As the procedure is performed, rollers 26*a* and 26*b* move toward each other to further knead and massage the skin area. Rollers 26*a* and 26*b* rotate in the same clockwise direction 23 while housing 22 is moved across the treatment area of skin 12 in the direction indicated by arrow 27**.

The skin 12 has several underlying layers of fatty tissue. Layer 14 is a superficial fatty layer, layer 16 is a fascia superficialis layer, and layer 18 is a deep fatty layer. As device 10 is operated over the desired skin area, layers 14, 16 and 18 are drawn up in between the rollers **26*a* and 26*b***, and thereby the fatty tissue can be broken down during the ongoing procedure.

Figure 2A:
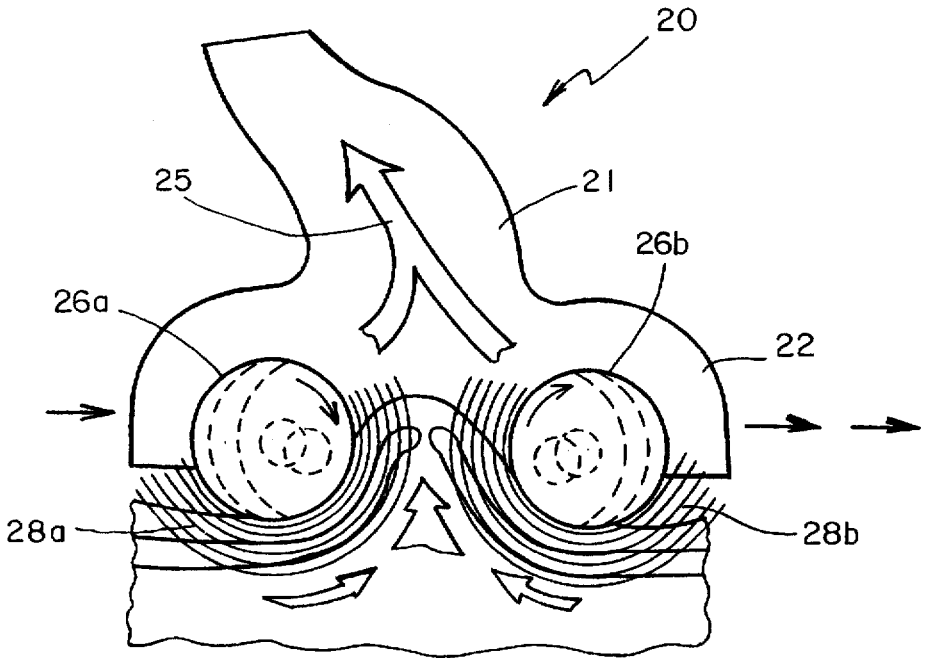
FIG. 2*a* is a plan view of a first embodiment of the endermology apparatus with ultrasound according to the invention.

FIG. 2 shows the combined endermology/ultrasound device 20 according to a first embodiment of the invention. Device 20 has a housing 22 and rollers **26*a* and 26*b* rotatably mounted in the housing for engaging the patient's skin. A vacuum source (not shown) is connected to vacuum connection 24 and creates a suction 25 in the direction shown. Each roller 26*a* and 26*b* contains an ultrasound generator/ transducer 36*a* and 36*b***(FIG. 3*a*) for generating ultrasonic wave energy **28*a* and 28*b***, respectively.

During operation, rollers **26*a* and 26*b* engage the skin to perform the massaging technique, and ultrasound generators/transducers 36*a* and 36*b*, respectively, are selectively activated by the operator to further increase the breakdown of fatty tissue. The application of ultrasonic wave energy has proven effective in the breaking down of sub-cutaneous fatty tissue. Thus, ultrasonic wave energy 28*a*** and 28*b* is applied through rollers 26*a* and 26*b*, respectively, to increase the breaking down of fatty tissue during the endermology procedure.

Figure 2B:
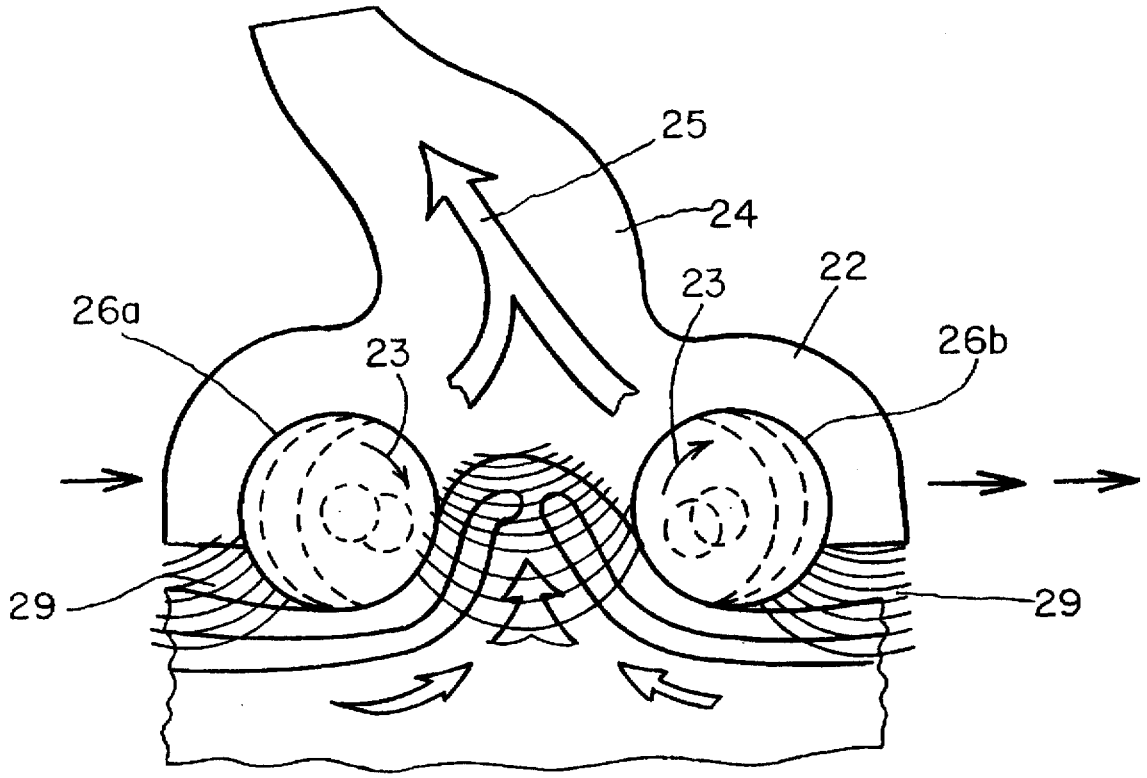
FIG. 2*b* is a plan view of a second embodiment of the endermology apparatus with ultrasound according to the invention.

FIG. 2*b* shows a second embodiment of the combined endermology/ultrasound device according to the invention. Ultrasound generators/transducers 40*a*–40*d* (FIG. 3*b*) are disposed within housing 22 and generate ultrasonic wave energy 29 directed at the skin area to be treated.

Figure 3A:
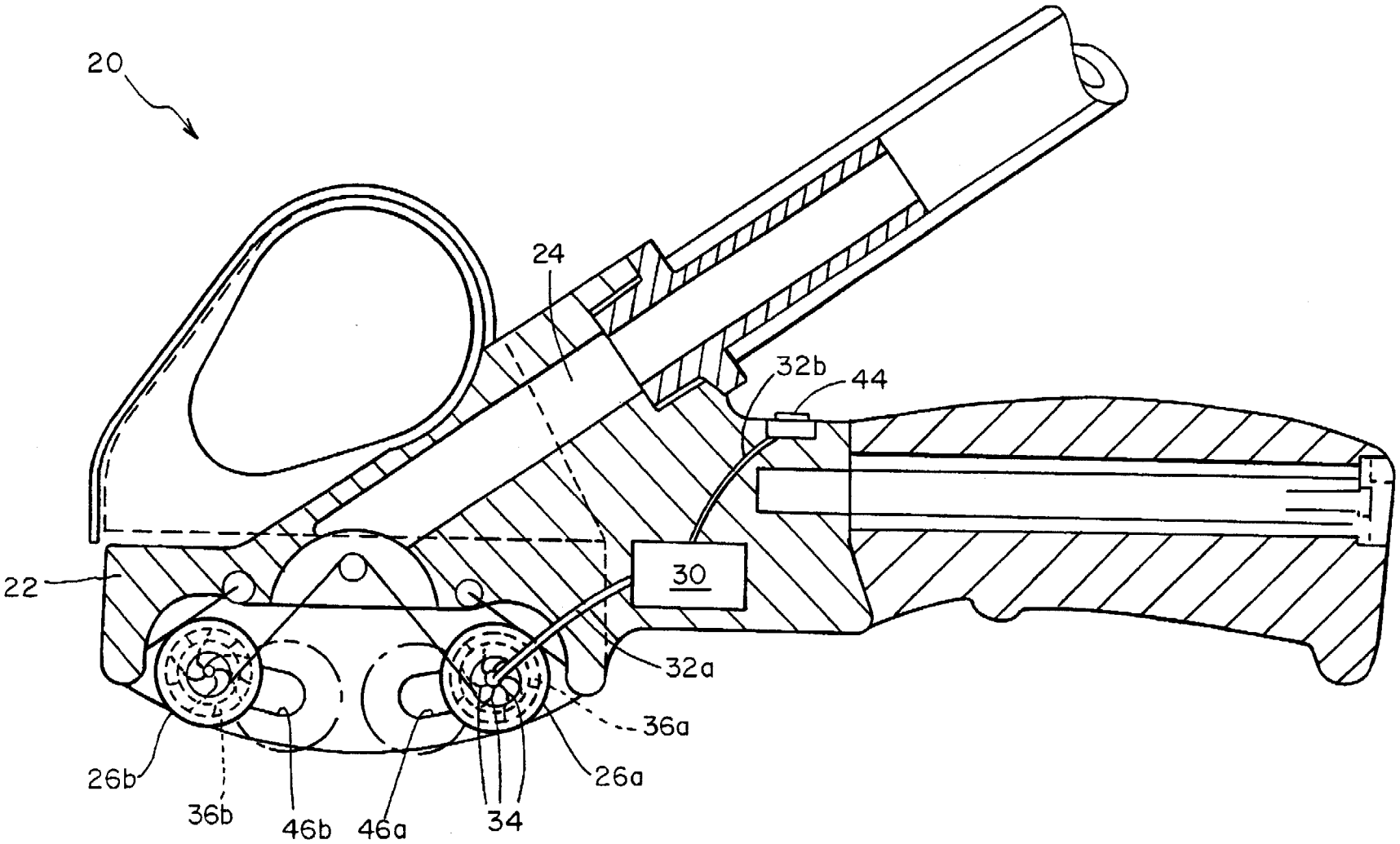
FIG. 3*a* is a cross sectional view of the endermology apparatus with ultrasound according to the first embodiment of the invention.

FIG. 3*a* shows a cross sectional view of the combined endermology/ultrasound device 20 according to the first embodiment of the invention. A power supply 30 is disposed within housing 22 and coupled to ultrasound generators/transducers 36*a* and 36*b* via coupling line 32*a* and rotary electric joint/switch 34. Ultrasound generators/transducers 36*a* and 36*b* can be of any suitable known type such as, for example, a lead-zirconate-titante transducer, or a piezoelectric-Izt-sandwich construction type transducer. Power supply 30 can be a DC power source that receives its power from an internal battery supply. The internal battery can be replaceable or rechargeable according to design. In the alternative, power supply can be an AC power source that is externally connected to an AC power supply. Ultrasound generators/transducers 36*a* and 36*b* produce ultrasonic wave energy in a frequency range of 10–40 KHz. The lower the frequency level, the more intense the ultrasound wave energy is.

A switch 44 is located on the outer surface of housing 22 and is coupled to power supply 30 via coupling line 32*b*. Switch 44 enables the operator to selectively apply ultrasonic energy to the area being treated by device 20. Switch 44 can be locked into the on position to provide a continuous flow of ultrasonic wave energy to the treated area. Generally, ultrasound generators have high power requirements, and as such would require an AC power source.

FIG. 3*a* more clearly shows axis paths 46*a* and 46*b* for rollers 36*a* and 36*b*, respectively. When the skin is drawn into device 22 by vacuum suction 25 (FIGS. 2*a* and 2*b*) and between rollers 36*a* and 36*b*, said rollers move toward each other along paths 46*a* and 46*b*, respectively, to increase the kneading or massaging action of the device.

Figure 3B:
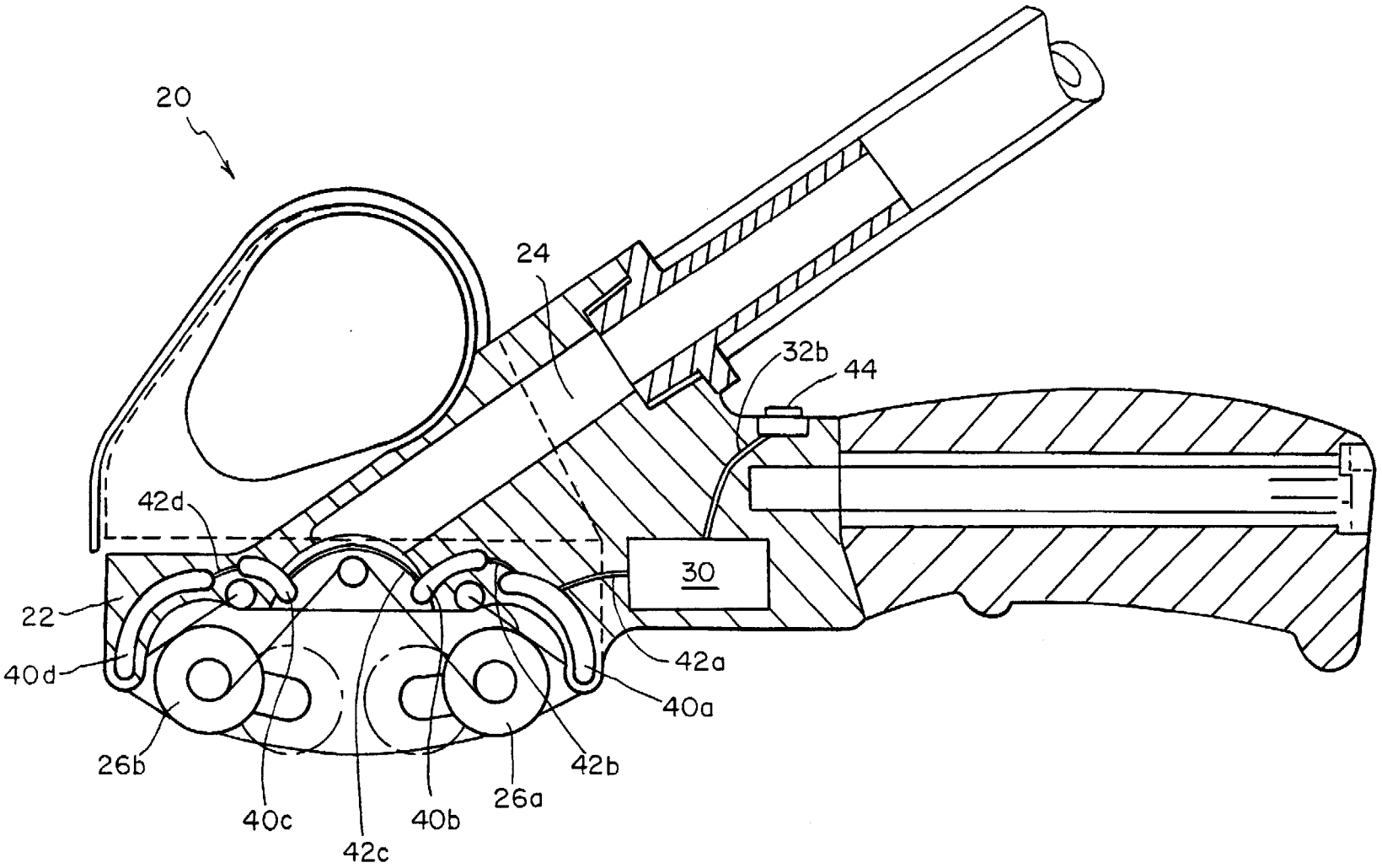
FIG. 3*b* is a cross sectional view of the endermology apparatus with ultrasound according to the second embodiment of the invention.

FIG. 3*b* shows a cross sectional view of the combined endermology/ultrasound device 20 according to the second embodiment of the invention. A plurality of ultrasound generators/transducers 40*a*–40*d* are disposed within housing 22 around rollers 26*a* and 26*b*. Power supply 30 is connected to the ultrasound generators via connecting lines 42*a*–42*d*, and switch 44 is coupled to power supply 30 via coupling line 32*b*. Switch 44 can be any suitable know type of switch for enabling the selective activation of power supply 30, and thereby ultrasound generators/transducers 40*a*–40*d*. Ultrasound generators/transducers 40–40*d* preferably operate in a frequency range of 10–40 KHz, and may be of any suitable known type.

While two embodiments of the present invention have been shown and described, it is to be understood that many changes and modifications may be made thereunto without departing from the spirit and scope of the invention as defined in the appended claims.

What is claimed is:

1. A combination endermology ultrasound apparatus for breaking down subcutaneous fatty tissue beneath the skin surface, the combination comprising:

an endermology body massager including a housing having a vacuum input for connection with a vacuum source, a vacuum chamber coupled to the vacuum input, and at least two spaced apart parallel rollers rotatably mounted in said chamber; and ultrasound means disposed within said housing for emitting ultrasonic energy to the skin surface.

2. The combination according to claim 1, wherein said ultrasound means comprises:

a power supply for generating power;

a plurality of ultrasound generators/transducers disposed within said rollers and being coupled to said power supply; and switching means connected to said power supply for selectively activating said plurality of ultrasound generators/transducers.

3. The combination according to claim 2, wherein said power supply is a DC battery contained within said housing.

4. The combination according to claim 3, wherein said DC battery is rechargeable.

5. The combination according to claim 2, wherein said power supply is an AC power source.

6. The combination according to claim 1, wherein said ultrasound means comprises:

a power supply for generating power;

a plurality of ultrasound generators/transducers disposed within said housing and being coupled to said power supply; and switching means connected to said power supply for selectively activating said plurality of ultrasound generators/transducers.

7. The combination according to claim 6, wherein said power supply comprises a DC battery releasably contained within said housing.

8. The combination according to claim 7, wherein said power supply comprises an AC power source.

* * * * *